US007390199B2

(12) United States Patent
Honda et al.

(10) Patent No.: US 7,390,199 B2
(45) Date of Patent: Jun. 24, 2008

(54) CONNECTOR MOUNTING STRUCTURE

(75) Inventors: Takayoshi Honda, Kariya (JP); Tadashi Tsuruzawa, Chiryu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 11/790,110

(22) Filed: Apr. 24, 2007

(65) Prior Publication Data

US 2007/0264851 A1 Nov. 15, 2007

(30) Foreign Application Priority Data

May 12, 2006 (JP) ..... 2006-134411

(51) Int. Cl.
*H01R 12/00* (2006.01)

(52) U.S. Cl. ..... 439/78

(58) Field of Classification Search ..... 439/79, 439/83, 573, 76.1, 157, 78; 361/752–753, 361/724, 796, 756
See application file for complete search history.

(56) References Cited

U.S. PATENT DOCUMENTS 4,583,807 A * 4/1986 Kaufman et al. ..... 439/83
5,580,269 A * 12/1996 Fan ..... 439/79
6,707,678 B2 * 3/2004 Kobayashi et al. ..... 361/752
6,866,524 B2 3/2005 Takata

FOREIGN PATENT DOCUMENTS

JP A-2000-003743 1/2000
JP A-2005-135765 5/2005

OTHER PUBLICATIONS

U.S. Appl. No. 11/711,147, filed Feb. 27, 2007, Itou et al.

* cited by examiner

*Primary Examiner*—Edwin A. Leon
(74) *Attorney, Agent, or Firm*—Posz Law Group, PLC

(57) ABSTRACT

A connector mounting structure includes a circuit board and a male connector. The male connector is surface-mounted to the circuit board and has a housing and terminals. The housing includes a body member and a fixing member fixed to the body member. The fixing member has a tube portion and a protection portion. The tube portion receives a housing of an external female connector. Each terminal has first and second ends. The first end is exposed to a surface of the body member and soldered to the circuit board. The second end is also exposed to the surface of the body member to be electrically connectable to the female connector. The protection portion is placed between the first and second ends in a thickness direction of the circuit board to cover facing area between adjacent first ends.

23 Claims, 7 Drawing Sheets

CONNECTOR MOUNTING STRUCTURE

CROSS REFERENCE TO RELATED APPLICATION

This application is based on and incorporates herein by reference Japanese Patent Application No. 2006-134411 filed on May 12, 2006.

FIELD OF THE INVENTION

The present invention relates to a connector mounting structure in which a male connector is surface-mounted to a circuit board.

BACKGROUND OF THE INVENTION

A connector mounting structure for mounting a male connector to a circuit board is disclosed in, for example, U.S. Pat. No. 6,866,524 corresponding to JP-A-2004-206924. In the mounting structure, connector terminals extending from a connector housing are electrically connected (i.e., surface-mounted) to conductive lands formed on a mounting surface of a circuit board by reflow soldering to achieve high circuit density, miniaturization, and efficient manufacturing process.

The connector terminals have first end portions exposed to a first side of the connector housing and soldered to the circuit board and have second end portions exposed to a second side opposite to the first side to be connectable to a female connector. In short, the first and second end portions are exposed to the different sides of the connector housing. Therefore, as the number of the connector terminals (i.e., circuit density) is increased, the connector housing is longitudinally elongated so that the size of the circuit board is increased in a direction along the mounting surface. Accordingly, the size of an electronic apparatus employing the circuit board is increased. If the first and second end portions are exposed to the same side of the connector housing, the number of the terminals may be increased without increasing the size of the electronic apparatus.

However, in the case where the first and second end portions are exposed to the same side of the connector housing, the first end portions need to be soldered to the circuit board through inside the connector housing in view of the fact that temperature becomes high in the reflow soldering. Therefore, the connector housing needs to be placed on the circuit board, and the mounting surface is reduced accordingly. The size of the circuit board cannot be reduced, and the size of the electronic apparatus cannot be reduced.

Further, in the case where the first and second end portions are exposed to the same side of the connector housing, the first end portions are exposed to outside before the male connector is mated with the female connector. Therefore, short-circuit between adjacent first end portions may be caused by a conductive foreign matter that falls on the first end portions before the male connector is mated with the female connector. The short-circuit may be caused by the foreign matter that sticks to the female connector and falls on the first end portions after the male connector is mated with the female connector.

In a connector mounting structure disclosed in Japanese Patent Application No. 2006-55383 filed by some of the present applicants, the connector housing is assembled as one piece from separate pieces to reduce the size of a circuit board, i.e., to increase circuit density of the circuit board. However, the short circuit cause by the foreign matter is not taken into consideration.

SUMMARY OF THE INVENTION

In view of the above-described problem, it is an object of the present invention to provide a connector mounting structure in which a male connector is surface-mounted to a circuit board in such a manner that both ends of a connector terminals are exposed to the same side of a connector housing, the structure improving circuit density of the circuit board and reducing a possibility of short-circuit between the connector terminals.

The connector mounting structure includes a circuit board and a male connector capable of being mated with an external female connector. The male connector is surface-mounted to a mounting surface of the circuit board and has a connector housing and a plurality of male terminals.

The connector housing includes a body member and a fixing member fixed to the body member. The body member has a surface, and the fixing member has a tube portion and a protection portion. The tube portion receives a connector housing of the female connector, when the male connector is mated with the female connector.

Each of the male terminals is fixed in the body member and has first and second end portions and a joint portion. The first end portion is exposed to the surface of the body member and electrically connected to the circuit board. The second end portion is also exposed to the surface of the body member and placed above the first end portion in a thickness direction of the circuit board to be electrically connectable to the female connector. The joint portion connects the first and second end portions and is fixed in the body member. The protection portion is placed between the first and second end portions in the thickness direction of the circuit board to cover facing area between adjacent first end portions.

According to the connector mounting structure, both the first and second end portions of each of the male terminals are exposed to the same surface of the body member. Further, the body member and the fixing member of the connector housing are separate pieces. The connector housing is assembled as one piece from the body member and the fixing member in such a manner that the body member is at least partially placed in the tube portion of the fixing member. In such an approach, the circuit board can be reduced in size in a direction along the mounting surface.

Further, according to the connector mounting structure, the protection portion covers the facing area between the adjacent first end portions to prevent a foreign matter from touching the adjacent first end portions at one time. In such an approach, short-circuit caused by the foreign matter can be reduced without increasing the size of the circuit board.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENTS

Figure 1A:
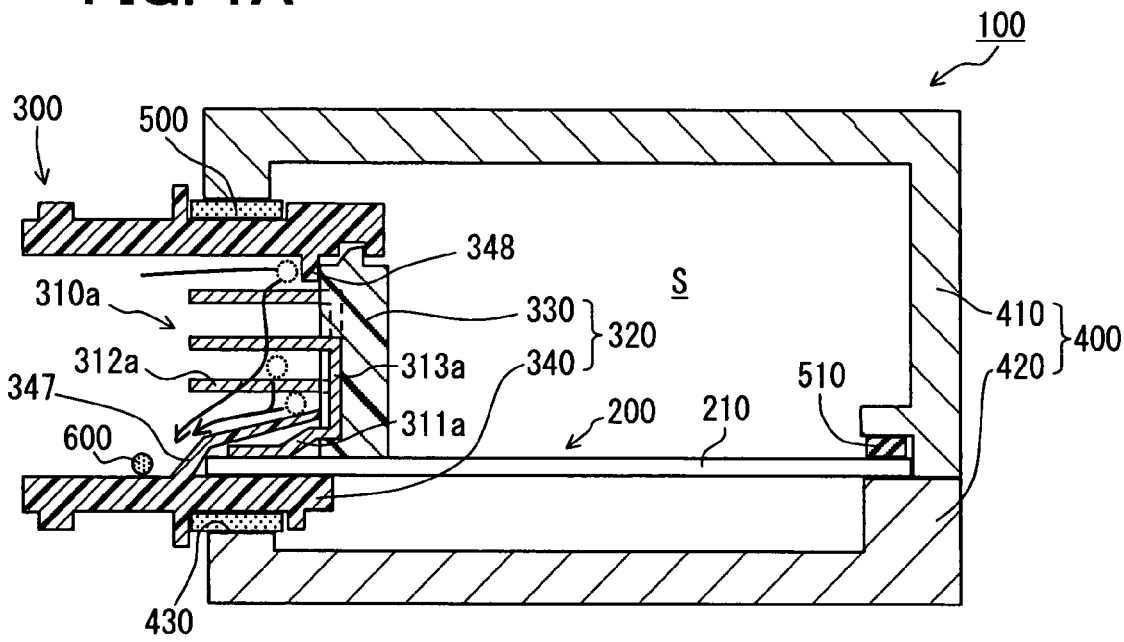
FIG. 1A is a cross-sectional view of an electronic apparatus including a circuit board and a male connector mounted to the circuit board by a connector mounting structure according to a first embodiment of the present invention.
Figure 1B:
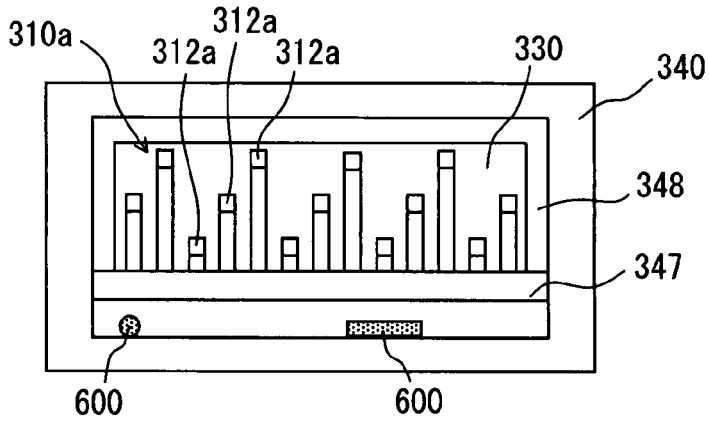
FIG. 1B is a rear view of FIG. 1A from a side where the male connector is mated with an external female connector.
Figure 1C:
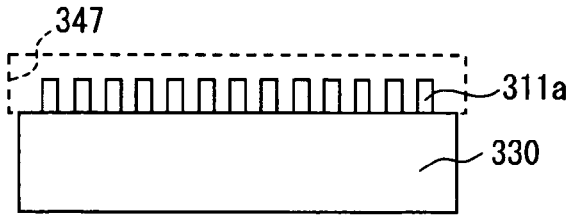
FIG. 1C is a view showing area of a first protection portion of the male connector of FIG. 1A.

As shown in FIGS. 1A-1C, an electronic apparatus 100 includes a circuit board 200, a male connector 300 surface-mounted to the circuit board 200, and a casing 400 for housing the circuit board 200. The male connector 300 has a connector mounting structure according to a first embodiment of the present invention. A sealant 500 seals the electronic apparatus 100 so that an inner space S of the electronic apparatus 100 is waterproofed, i.e., protected from water damage. For example, therefore, the electronic apparatus 100 may be suitable for an engine electronic control unit (ECU) installed in an engine room, which is located on the exterior of a vehicle.

The circuit board 200 includes a printed board 210 and electronic devices mounted to the printed board 210. For example, the electronic devices are a microcomputer, a resistor, a capacitor, and the like, which are not shown in the drawings. The male connector 300 is one example of the electronic devices. The printed board 210 is provided with conductive patterns and via holes for connecting the conductive patterns. The printed board 210 is made of a known material such as a thermoplastic resin, a thermoset resin, a ceramic, or a glass/resin composite material (e.g., glass-cloth). In the first embodiment, the printed board 210 is a multilayered board that uses a FR-5-equivalent board made of a glass/epoxy-resin composite material and has a multi-layered conductive pattern.

The male connector 300 includes a connector housing 320 and a plurality of first terminals 310*a* mounted in the connector housing 320. Each first terminal 310*a* is made of an electrically conductive material such as a metal plated brass. The connector housing 320 is made of an electrically insulating material such as a synthetic resin. The male connector 300 is mounted to the circuit board 200 and acts as an input/output interface of the circuit board 200.

The connector housing 320 includes a body member 330 and a fixing member 340. The body member 330 and the fixing member 340 are separate pieces. Each of the first terminals 310*a* is mounted to the body member 330. The fixing member 340 has first, second, and third fixing portion 341-343. The first, second, and third fixing portions 341-343 are used to fix the fixing member 340 to, an external female connector to be mated with the male connector 300, the casing 400 via the sealant 500, and the body member 330, respectively. At least the first fixing portion 341 is shaped like a tube to receive a connector housing of the female connector.

Figure 2A:
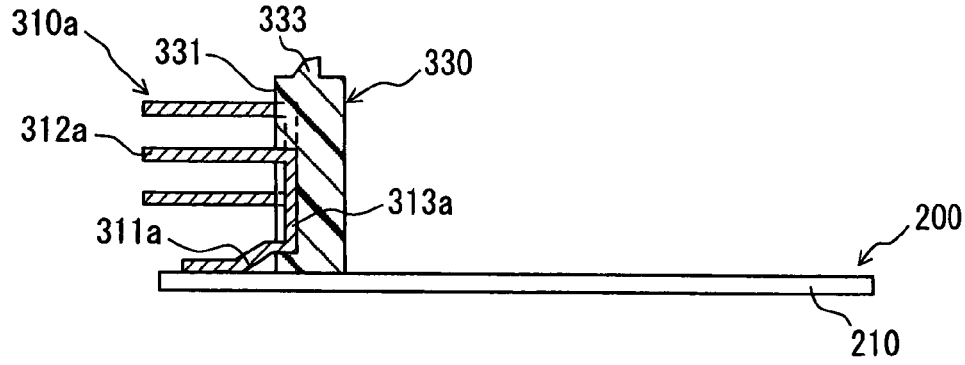
FIG. 2A is a cross-sectional view of a body member of a connector housing of the male connector of FIG. 1A.
Figure 2B:
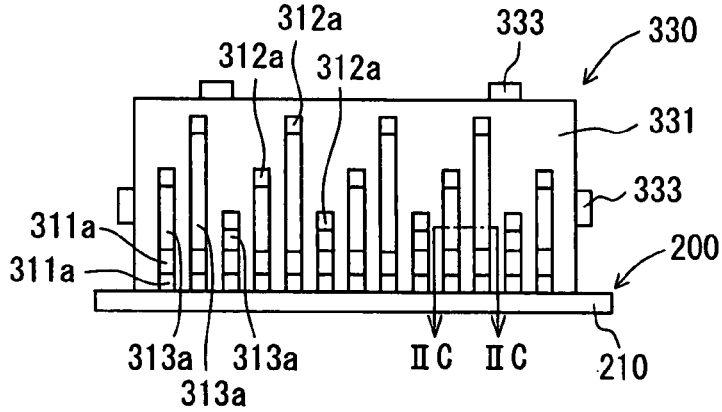
FIG. 2B is a rear view of FIG. 2A from the side where the male connector is mated with the external female connector.

As shown in FIGS. 1A, 2A, and 2B, each of the first terminals 310*a* has a first end portion 311*a*, a second end portion 312*a*, and a joint portion 313*a*. The first end portion 311*a* is exposed to a first longitudinal surface 331 of the body member 330 and soldered to a conductive land formed on a mounting surface of the printed board 210. The second end portion 312*a* is also exposed to the first longitudinal surface 331 of the body member 330 to be electrically connectable to the female connector. Therefore, the first end portion 311*a* and the second end portion 312*a* extend to the same side with respect to the body member 330. The joint portion 313*a* connects the first end portion 311*a* and the second end portion 312*a* so that the first terminal 310*a* is approximately C-shaped. The first end portion 311*a* is positioned below the second end portion 312*a* in a thickness direction of the circuit board 200 in a condition where the first terminal 310*a* is mounted to the circuit board 200 (i.e., the first end portion 311*a* is soldered to the conductive land formed on the mounting surface of the circuit board 200).

The body member 330 is shaped like an approximately rectangular solid and has the first longitudinal surface 331. The first longitudinal surface 331 of the body member 330 is approximately perpendicular to the mounting surface of the circuit board 200. As described above, each of the first and second end portions 311*a*, 312*a* is exposed to and extends from the first longitudinal surface 331. Thus, the first terminals 310*a* are arranged in a longitudinal direction of the body member 330.

Figure 2C:
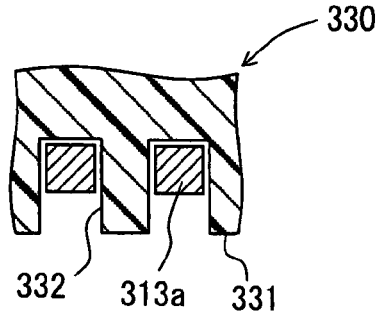
FIG. 2C is a cross-sectional view taken along line IIC-IIC of FIG. 2B.

As shown in FIG. 2C, the body member 330 has a plurality of slits 332 on the first longitudinal surface 331. The joint portion 313*a* of the first terminal 310*a* is placed and fixed in a corresponding one of the slits 332. Each slit 332 has a depth enough to fully accommodate the joint portion 313*a* so that the joint portion 313*a* is not exposed to the first longitudinal surface 331. Therefore, short-circuit caused by a conductive foreign matter 600 between adjacent joint portions 313*a* can be reduced.

As shown in FIGS. 2A and 2B, an engagement portion 333 is integrally provided on each of side surfaces, adjacent to the first longitudinal surface 331, and a top surface of the body member 330. The body member 330 and the fixing member 340 are fixed together by the engagement portion 333.

Figure 3A:
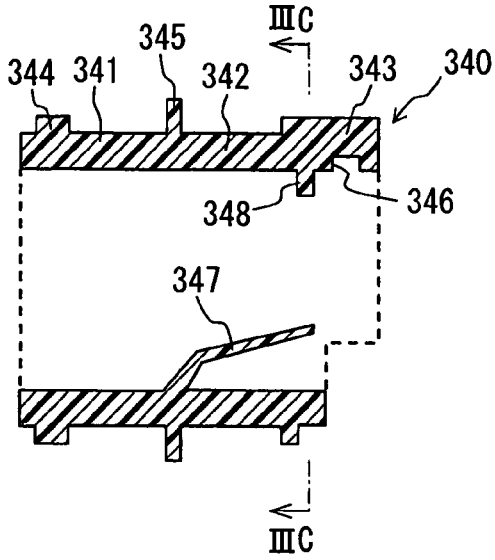
FIG. 3A is a cross-sectional view of a fixing member of the connector housing of the male connector of FIG. 1A.
Figure 3B:
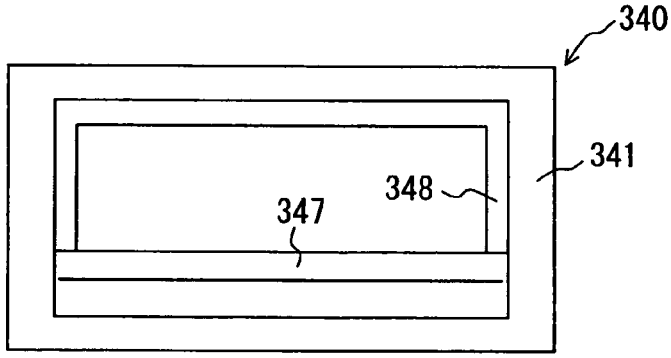
FIG. 3B is a rear view of FIG. 3A from the side where the male connector is mated with the external female connector.

As described above, the fixing member 340 has a tube portion at least at the first fixing portion 341, as shown in FIG. 3A. The connector housing of the female connector is received in the tube portion of the fixing member 340 so that the male connector 300 can be mated with the female connector. The first, second, and third fixing portions 341-343 of the fixing member 340 are arranged in that order from an open side of the tube portion where the male connector 300 is mated with the female connector. When the body member 330 of the male connector 300 is mounted to the circuit board 200 and fixed to the fixing member 340, the circuit board 200 and the body member 330 are at least partially received in the tube portion of the fixing member 340 so that the first end portion 311*a* of the first terminal 310*a* is placed inside the tube portion.

The first, second, and third fixing portions 341-343 are described in detail below. First and second projections 344, 345, which are spaced from each other, are provided on an outer surface of the tube portion of the fixing member 340. The first fixing portion 341 extends from the opening of the tube portion to an edge of the second projection 345. Therefore, the first fixing portion 341 includes the first projection 344 and a first recess between the first and second projections 344, 345, and does not include the second projection portion 345. The first projection 344 can be received in a receiver of the connector housing of the female connector. The second fixing portion 342 includes the second projection 345 and a second recess. The first and second recesses are opposite to each other across the second projection 345. Return to FIG. 1A, the sealant 500 is disposed in the second recess, and an opening edge 430 of a connector opening of the casing 400 is attached to the second recess through the sealant 500. The rest of the fixing member 340 is the third fixing portion 343. A slit 346 for receiving the engagement portion 333 of the body member 330 is provided on an inner surface of the third fixing portion 343 of the fixing member 340.

Figure 3C:
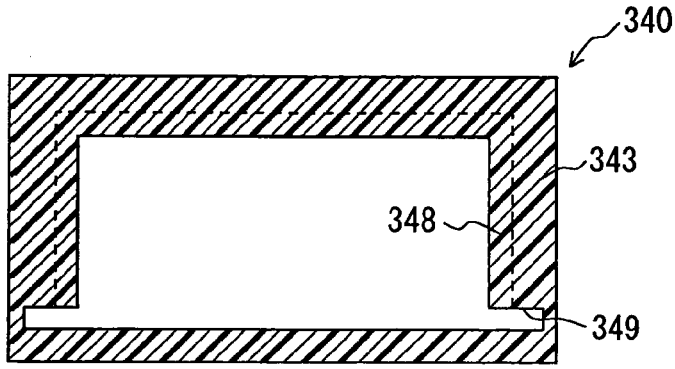
FIG. 3C is a cross-sectional view taken along line IIIC-IIIC of FIG. 3A.

As shown in FIG. 3C, a guiding slit 349 for receiving both sides of the circuit board 200 is provided on an inner surface of the fixing member 340 (specifically, the second and third fixing portions 342, 343). The circuit board 200 can be positioned with respect to the fixing member 340 by inserting both sides of the circuit board 200 into the guiding slit 349. The guiding slit 349 has a predetermined length and extends in a longitudinal direction of the fixing member 340 from an opposite side to the open side of the tube portion. The guiding slit 349 has a uniform width equal to or slightly larger than a thickness of the printed board 210.

As described above, the connector housing 320 of the male connector 300 is assembled as one piece from the separate pieces, i.e., the body member 330 and the fixing member 340. Therefore, the male connector 300 can be easily and reliably mounted to the circuit board 200 as follows.

First, the body member 330 is mounted to the circuit board 200 by reflow soldering. Specifically, the first end portion 311*a* exposed to the first longitudinal surface 331 of the body member 330 is soldered to the conductive land formed on the printed board 200.

Second, the circuit board 200 is positioned with respect to the fixing member 340 by using the guiding slit 349.

Finally, the engagement portion 333 of the body member 330 is received in the slit 346 of the fixing member 340 so that the body member 330 and the fixing member 340 are fixed together.

Thus, the male connector 300 is mounted to the circuit board 200 by using the connector mounting structure according to the first embodiment.

Further, as shown FIGS. 1A, 3A, the fixing member 340 includes first and second protection portions 347, 348, each of which is unitary with the fixing member 340 and made of the same material as the fixing member 340.

The first protection portion 347 projects from a bottom inner surface of the tube portion of the fixing member 340. In the condition where the body member 330 and the fixing member 340 are fixed together, the first protection portion 347 is placed between the first and second end portions 311*a*, 312*a* in the thickness direction of the circuit board 200 and touches the first longitudinal surface 331 of the body member 330. The first protection portion 347 covers at least a first facing area between adjacent first end portions 311*a* without touching the adjacent first end portions 311*a*. Thus, it is unlikely one foreign matter 600 touches both the adjacent first end portions 311*a* at the same time. Thus, short-circuit caused by the foreign matter 600 between the adjacent first end portions 311*a* can be reduced.

The first protection portion 347 extends from a first point further away from the first longitudinal surface 331 of the body member 330 than a second point to which the first end portion 311*a* extends. When the foreign matter 600 falls and stays on the first protection portion 347, the foreign matter 600 may cause short circuit between adjacent second end portions 312*a*. The first protection portion 347 has a slope portion so that a gap between the first protection portion 347 and the mounting surface of the circuit board 200 decreases with distance from the body member 330. When the foreign matter 600 falls on the first protection portion 347, the foreign matter 600 rolls or slides down the first protection portion 347 away from the body member 330, as shown in FIG. 1A. Thus, the short-circuit caused by the foreign matter 600 between adjacent second end portions 312*a* can be reduced.

The second protection portion 348 projects from a top inner surface of the fixing member 340. In the condition where the body member 330 and the fixing member 340 are fixed together, the second protection portion 348 touches an edge portion of the first longitudinal surface 331 of the body member 330. The second protection portion 348 prevents the foreign matter 600 from entering the inner space S of the casing 400 via a clearance between the body member 330 and the fixing member 340. The second protection portion 348 reduces or complicates the clearance, i.e., a passage to the inner space S. Preferably, the second protection portion 348 seals the clearance. In the first embodiment, the second protection portion 348 projects inwardly from the inner surface of the third fixing portion 343 of the fixing member 340, as shown in FIG. 3A.

The casing 400 is made of synthetic resin or metal such as aluminum or iron. The casing 400 includes a case 410 shaped like a box with an opening and a cover 420 shaped like a rectangular plate. The cover 420 is attached to the case 410 by a screw, for example. Thus, the opening of the case 410 is covered with the cover 420 to produce the inner space S of the casing 400. In the first embodiment, the casing 400 is constructed from two pieces, i.e., the case 410 and the cover 420. Alternatively, the casing 400 may be a single piece or constructed from three or more pieces. The circuit board 200 is sandwiched between the case 410 and the cover 420 through an elastic member 510 such as a rubber. Thus, the circuit board 200 is fixed to the casing 400.

The casing 400 has the connector opening for receiving the male connector 300. Due to the connector opening, the second end portion 312*a* of the first terminal 310*a* of the male connector 300 is exposed outside the casing 400 in a condition where the circuit board 200 is housed in the casing 400. Thus, the circuit board 200 can be electrically connected to the female connector through the male connector 300. As described above, in the first embodiment, the sealant 500 is placed between the opening edge 430 of the connector opening of the casing 400 and the second fixing portion 342 of the fixing member 340.

The sealant 500 is made of a material having elasticity and adhesion enough to seal the casing 400. The inner space S of the casing 400 is protected from the water damage in a condition where the male connector 300 is mated with the female connector. For example, the sealant 500 is moisture curing silicone adhesive having hardness (i.e., viscosity) of between 150 pascal-second (Pa·s) and 200 Pa·s before the adhesive cures. Alternatively, the sealant 500 may be a material disclosed in JP-2005-93602 related to the invention of the present applicants.

In the connector mounting structure according to the first embodiment, the male connector 300 includes the first terminal 310*a* having the first and second end portions 311*a*, 312*a*. Each of the first and second end portions 311*a*, 312*a* is exposed to and extends from the first longitudinal surface 331 of the body member 330. The connector housing 320 of the male connector 300 is assembled as one piece from the separate pieces, i.e., the body member 330 and the fixing member 340. In the condition where the body member 330 is mounted to the circuit board 200 by the reflow soldering, the body member 330 and the fixing member 340 are fixed together. In such an approach, the circuit board 200 can be reduced in size in the direction along the mounting surface.

The fixing member 340 has the first protection portion 347. In the condition where the body member 330 and the fixing member 340 are fixed together, the first protection portion 347 is placed between the first and second end portions 311*a*, 312*a* in the thickness direction of the circuit board 200 to cover at least the facing area between adjacent first end portions 311*a*. Thus, it is unlikely one foreign matter 600 touches both the adjacent first end portions 311*a* at the same time. Therefore, distance between adjacent first terminals 310*a* can be reduced. In such an approach, the circuit board 200 can be reduced in size in the direction along the mounting surface without increasing the possibility of the short-circuit caused by the foreign matter 600.

The fixing member 340 further has the second protection portion 348. In the condition where the body member 330 and the fixing member 340 are fixed together, the second protection portion 348 touches the edge portion of the first longitudinal surface 331 to seal the clearance between the body member 330 and the fixing member 340. Thus, the second protection portion 348 prevents the foreign matter 600 from entering the inner space S of the casing 400 via the clearance between the body member 330 and the fixing member 340.

Figure 4A:
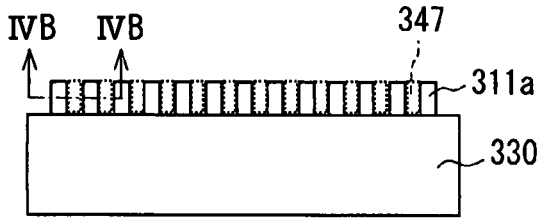
FIG. 4A is a view showing a first protection portion according to a modification of the first embodiment.
Figure 4B:
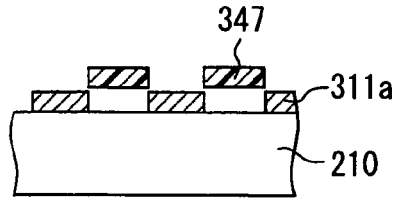
FIG. 4B is a cross-sectional view taken along line IVB-IVB of FIG. 4A.

In the first embodiment, the first protection portion 347 extends from the first point further away from the first longitudinal surface 331 than the second point to which the first end portion 311*a* extends. In such an approach, the short-circuit between the adjacent first end portions 311*a* can be surely prevented. Alternatively, the first protection portion 347 may be provided as shown in FIGS. 4A and 4B, where the first protection portion 347 covers only the facing area between the adjacent first end portions 311*a*.

Figure 5:
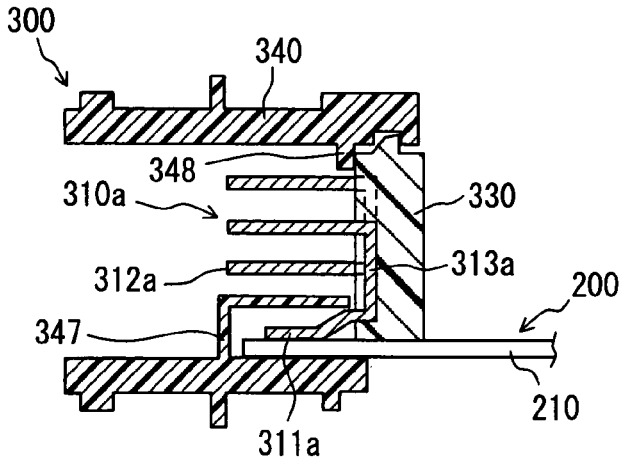
FIG. 5 is a cross-sectional view of a first protection portion according to another modification of the first embodiment.

In the first embodiment, the first protection portion 347 has the slope portion so that the gap between the first protection portion 347 and the mounting surface of the circuit board 200 decreases with the distance from the body member 330. When the foreign matter 600 falls on the first protection portion 347, the foreign matter 600 rolls or slides down the first protection portion 347 away from the body member 330. Therefore, even if gap between the first protection portion 347 and the second end portion 312*a* is small, the short-circuit caused by the foreign matter 600 between the adjacent second end portions 312*a* can be reduced. Alternatively, as shown in FIG. 5, the first protection portion 347 may not have the slope portion. In this case, the gap between the first protection portion 347 and the second end portion 312*a* needs to be increased.

Further, the first protection portion 347 touches the first longitudinal surface 331 of the body member 330 to prevent the foreign matter 600 from entering the first facing area between the adjacent first end portions 311*a* via a clearance between the first protection portion 347 and the first longitudinal surface 331. In such an approach, the short-circuit caused by the foreign matter 600 between the adjacent first end portions 311*a* can be surely reduced. In contrast, in the case of FIG. 5, the first protection portion 347 does not touch the first longitudinal surface 331. Therefore, the clearance between the first protection portion 347 and the first longitudinal surface 331 needs to be sealed with something.

Figure 6:
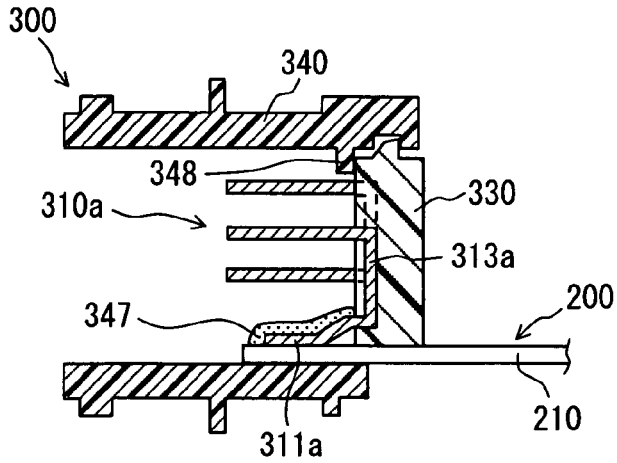
FIG. 6 is a cross-sectional view of a first protection portion according to another modification of the first embodiment.

In the first embodiment, the first protection portion 347 is unitary with the fixing member 340. Thus, structure of the male connector 300 can be simplified so that manufacturing steps can be reduced. Alternatively, as shown in FIG. 6, the first protection portion 347 may be separated from the fixing member 340. In the case of FIG. 6, an electrically insulating material (e.g., protective gel) coating on the first end portion 311*a* serves as the first protection portion 347.

When the first protection portion 347 is made of the electrically insulating material, it is preferable that the first protection portion 347 should be placed as close to the first end portion 311*a* as possible, as in the case of FIG. 5. In such an approach, gap between the first protection portion 347 and the second end portion 312*a* is increased so that the short-circuit caused by the foreign matter 600 between the adjacent second end portions 312*a* can be reduced. It is more preferable that the first protection portion 347 should touch the first end portion 311*a*, as in the case of FIG. 6.

Second Embodiment

The second embodiment of the present invention is described with reference to FIGS. 7A, 7B, and 8.

As described above, in the first embodiment, the joint portion 313*a* of the first terminal 310*a* is placed in the slit 332 and fixed inside the body member 330. The slit 332 has the depth enough to fully accommodate the joint portion 313*a* so that the joint portion 313*a* is not exposed to the first longitudinal surface 331, i.e., a whole portion of the joint portion 313*a* is placed in the slit 332. Thus, the short-circuit caused by the foreign matter 600 between the adjacent joint portions 313*a* is reduced by adjusting the depth of the slit 332.

In the second embodiment, the fixing member 340 has a third protection portion 350 and does not have the second protection portion 348. The third protection portion 350 is provided in front of the first longitudinal surface 331 of the body member 330 to cover at least the joint portion 313*a* and a second facing area between the adjacent joint portions 313*a* in the condition where the body member 330 and the fixing member 340 are fixed together. The short-circuit caused by the foreign matter 600 between the adjacent joint portions 313*a* can be reduced by the third protection portion 350.

When the male connector 300 is mated with the female connector, a contact portion of the second end portion 312*a* is electrically connected to the female connector. At least the contact portion of the second end portion 312*a* is placed further forward than the third protection portion 350 with respect to the first longitudinal surface 331 of the body member 330. Thus, although the third protection portion 350 is provided in front of the first longitudinal surface 331, the second end portion 312*a* can be electrically connected to the female connector.

In the first embodiment, although the joint portion 313*a* is placed in the slit 332, a portion of the joint portion 313*a* is exposed as shown in FIG. 2C. In contrast, in the second embodiment, the third protection portion 350 covers both the joint portion 313*a* and the second facing area between the adjacent joint portions 313*a*. Thus, in the second embodiment, the short-circuit caused by the foreign matter 600 between the adjacent joint portions 313*a* can be reduced compared to in the first embodiment.

Figure 7A:
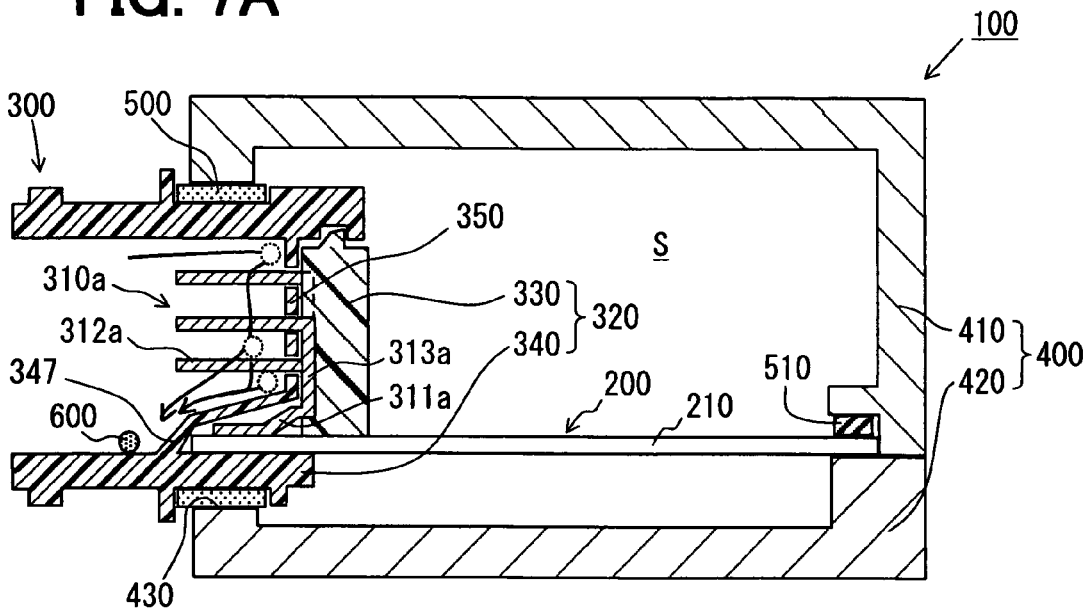
FIG. 7A is a cross-sectional view of an electronic apparatus including a circuit board and a male connector mounted to the circuit board by a connector mounting structure according to a second embodiment of the present invention.
Figure 7B:
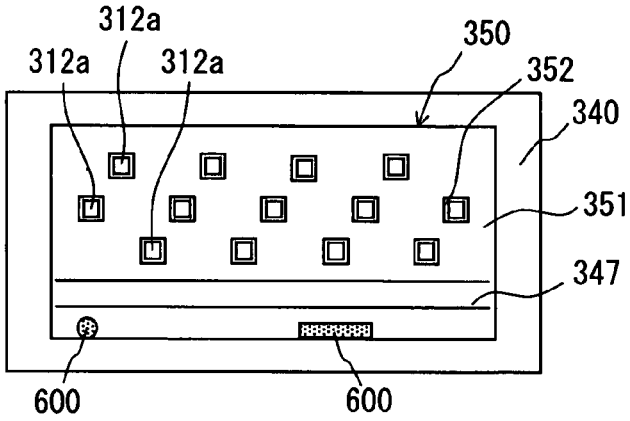
FIG. 7B is a rear view of FIG. 7A from the side where the male connector is mated with the external female connector.

As shown in FIGS. 7A, 7B, the third protection portion 350 is unitary with the fixing member 340 and made of the same material as the fixing member 340. The third protection portion 350 is also unitary with the first protection portion 347. Thus, the structure of the male connector 300 can be simplified so that the manufacturing steps can be reduced. In the second embodiment, the third protection portion 350 unitary with the first protection portion 347 is provided in front of the first longitudinal surface 331 to block the tube portion of the fixing member 340 to pass through between the second end portions 312*a* of the first terminal 310*a*. Thus, the third protection portion 350 seals the clearance between the body member 330 and the fixing member 340. In short, the third protection portion 350 can serve as the second protection portion 348 and prevent the foreign matter 600 from entering the inner space S of the casing 400 via the clearance. As with the first embodiment, the first protection portion 347 has the slope portion.

The third protection portion 350 includes a base portion 351 and hole portions 352 defined by inner walls 353 of the base portion 351. The base portion 351 is placed approximately parallel to the first longitudinal surface 331. Each second end portion 312*a* is inserted through a corresponding one of the hole portions 352. It is preferable that the third protection portion 350 should be placed as close to the first longitudinal surface 331 as possible to reduce the length of the second end portion 312*a*, i.e., to reduce the size of the electronic apparatus 100. It is more preferable that the third protection portion 350 should touch the first longitudinal surface 331. In the second embodiment, the third protection portion 350 is placed as close to the first longitudinal surface 331 as possible with space in the condition where the body member 330 and the fixing member 340 are fixed together.

As shown in FIGS. 7A, 7B, each hole portion 352 is a through hole that penetrates the base portion 351. The diameter of the hole portion 352 on the side where the male connector 300 is mated with the female connector is slightly larger than the diameter of the second end portion 312*a*. The hole portion 352 is tapered so that the diameter of the hole portion 352 is larger on the body member 330 side than on the side where the male connector 300 is mated with the female connector. Thus, each inner wall 353 of the hole portion 352 acts as a guiding member for guiding the second end portion 312*a* through the hole portion 352. The first terminal 310*a* can be positioned with respect to the body member 330 by inserting the second end portion 312*a* through the hole portion 352 of the third protection portion 350. Due to the fact that the hole portion 352 is tapered, the second end portion 312*a* can be easily inserted though the hole portion 352 without hitting against the base portion 351. Therefore, stress caused by the hit on junction between the first end portion 311*a* and the circuit board 200 can be reduced so that connection reliability between the first end portion 311*a* and the circuit board 200 can be ensured.

Figure 8:
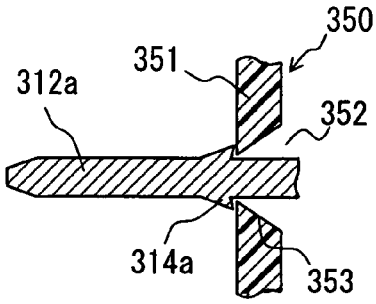
FIG. 8 is an enlarged cross-sectional view of a hole portion of a third protection portion of the male connector of FIG. 7A.

In the second embodiment, as shown in FIG. 8, the second end portion 312*a* except the contact portion has a projection 314*a* extending toward the body member 330. The projection 314*a* is placed further forward than the third protection portion 350 with respect to the first longitudinal surface 331 of the body member 330. Therefore, the contact portion of the second end portion 312*a* can be electrically connected to the female connector. Even when stress in a direction opposite to the insertion direction of the second end portion 312*a* is applied to the second end portion 312*a* in the condition where the body member 330 and the fixing member 340 are fixed together, the projection 314*a* of the second end portion 312*a* catches the third protection portion 350 to ensure the electrical connection between the second end portion 312*a* and the female connector. Thus, the male connector 300 can be reliably mated with the female connector.

According to the second embodiment, the third protection portion 350 is unitary with the first protection portion 347 and is provided in front of the first longitudinal surface 331 of the body member 330. The third protection portion 350 reduces the short-circuit not only between the adjacent joint portions 313*a* but also the adjacent first end portions 311*a*. The third protection portion 350 covers both the joint portion 313*a* and the second facing area between the adjacent joint portions 313*a*. In the second embodiment, therefore, the short-circuit between the adjacent joint portions 313*a* can be surely reduced compared to in the first embodiment.

Figure 9A:
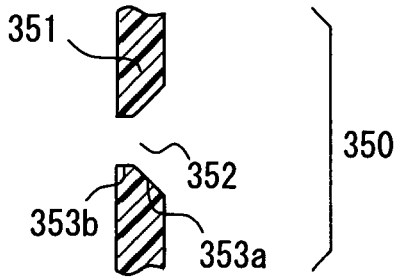
FIGS. 9A and 9B are enlarged cross-sectional views of hole portions according to a modification of the second embodiment.
Figure 9B:
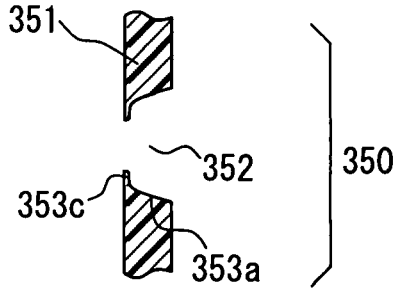

As described above, in the second embodiment, the diameter of the hole portion 352 changes over the thickness of the base portion 351 so that the hole portion 352 is fully tapered, i.e., does not have an uniform diameter portion. Alternatively, as shown in FIGS. 9A, 9B, the hole portion 352 may be partially tapered. In the case of FIG. 9A, the hole portion 352 is defined by a first inner wall 353*a* and a second inner wall 353*b*. The first inner wall 353*a* is on the side of the body member 330 and the hole portion 352 has a large diameter at the first inner wall 353*a* than at the second inner wall 353*b*. The hole portion 352 is not tapered at the first inner wall 353*a* and is tapered at the second inner wall 353*b*. In short, the hole portion 352 has an uniform diameter at the second inner wall 353*b*. The first inner wall 353*a* acts in the same manner as the inner wall 353 shown in FIG. 8. In the case of FIG. 9B, the hole portion 352 is defined by the first inner wall 353*a* and a thin-walled portion 353*c* that replaces the second inner wall 353*b*. As shown in FIG. 9B, the thin-walled portion 353*c* projects toward the center of the hole portion 352 and is thinned to be deformable. Therefore, even when the thin-walled portion 353*c* touches the second end portion 312*a* by the difference in thermal expansion coefficient between the body member 330 and the fixing member 340, stress applied to the second end portion 312*a* by the thin-walled portion 353*c* can be reduced due to the deformation of the thin-walled portion 353*c*. Further, even when the second end portion 312*a* is slightly displaced with respect to the corresponding hole portion 352 in the insertion step, the second end portion 312*a* can be inserted through the hole portion 352 due to the deformation of the thin-walled portion 353*c*.

Figure 10A:
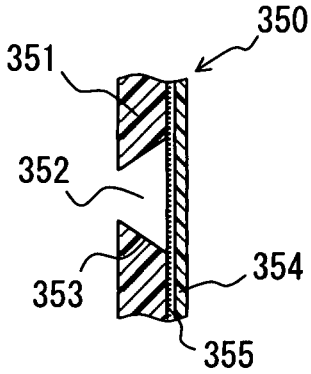
FIG. 10A is an enlarged cross-sectional view of a hole portion according to another modification of the second embodiment.
Figure 10B:
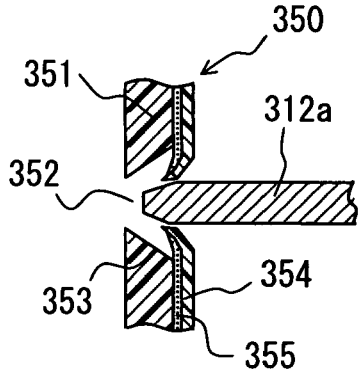
FIG. 10B is a view of FIG. 10A when a second end portion of the male connector of FIG. 7A is inserted through the hole portion.

As described above, in the second embodiment, the hole portion 352 is a through hole. Alternatively, the hole portion 352 may be a blind hole and have a bottom before the second end portion 312*a* is inserted through the hole portion 352. For example, the second end portion 312*a* may penetrate the bottom of the hole portion 352 by using force caused when the body member 330 and the fixing member 340 are fixed together. Specifically, as shown in FIG. 10A, the third protection portion 350 includes a thin film member 354 having a first surface bonded on the base portion 351 via an adhesive member 355 and a second surface facing the first longitudinal surface 331 of the body member 330. The thin film member 354 serves as the bottom of the hole portion 352 so that the hole portion 352 can be the blind hole before the second end portion 312*a* is inserted through the hole portion 352. As shown in FIG. 10B, the second end portion 312*a* penetrates the thin film member 354, when the body member 330 and the fixing member 340 are fixed together. Thus, the second end portion 312*a* can be inserted through the hole portion 352. Further, the second end portion 312*a* penetrates the thin film member 354 from the side of the second surface, where the adhesive member 355 is not applied, to prevent adhesion of the adhesive member 355 to the second end portion 312*a*. Thus, adhesion of the foreign matter 60 to the second end portion 312*a* can be prevented. The thin film member 354 is made of an electrically insulating material.

Figure 11A:
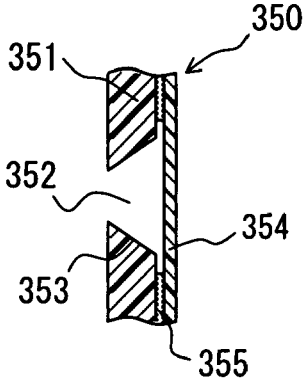
FIGS. 11A and 11B are enlarged cross-sectional view of hole portions according to another modification of the second embodiment.
Figure 11B:
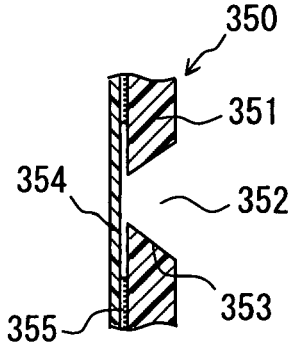

In the case of FIGS. 10A, 10B, the adhesive member 355 is applied to the entire first surface of the thin film member 354. Alternatively, as shown in FIG. 11A, the adhesive member 355 may be applied to the first surface of the thin film member 354 except the bottom of the hole portion 352 to surely prevent the adhesion of the adhesive member 355 to the second end portion 312*a*. In the case of FIGS. 10A, 10B, 11A, the thin film member 354 is bonded to the base portion 351 on the side of the body member 330. Alternatively, as shown in FIG. 11B, the thin film member 354 may be bonded to the base portion 351 on the side of the female connector.

As described above, in the second embodiment, the third protection portion 350 is unitary with the fixing member 340 and made of the same material as the fixing member 340. Further, the third protection portion 350 is unitary with the first protection portion 347. Alternatively, the third protection portion 350 may not be unitary with the fixing member 340 and/or may not be unitary with the first protection portion 347. In this case, it is required that the third protection portion 350 is placed in front of the first longitudinal surface 331 to cover at least the joint portion 313*a* and the facing area between the adjacent joint portions 313*a*. Further, it is required that at least the contact portion of the second end portion 312*a* is placed further forward than the third protection portion 350 with respect to the first longitudinal surface 331 of the body member 330.

Modifications

Figure 12:
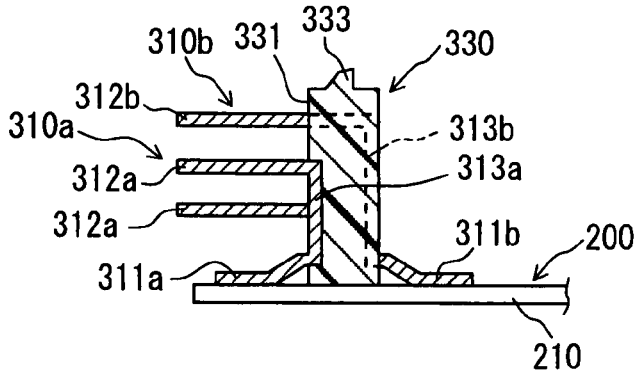
FIG. 12 is a cross-sectional view of a connector terminal according to a modification of the present invention.

The embodiments described above may be modified in various ways. For example, at least one of the first terminals 310*a* may be placed with a second terminal 310*b*. The second terminal 310*b* has a third end portion 311*b*, a fourth end portion 312*b*, and a joint portion 313*b*, which are correspond to the first end portion 311*a*, the second end portion 312*a*, and the joint portion 313*a* of the first terminal 310*a*, respectively. As shown in FIG. 12, while the first end portion 311*a* is exposed to and extends from the first longitudinal surface 331 of the body member 330, the third end portion 311*b* is exposed to and extends from a second longitudinal surface opposite to the first longitudinal surface 331.

Figure 13:
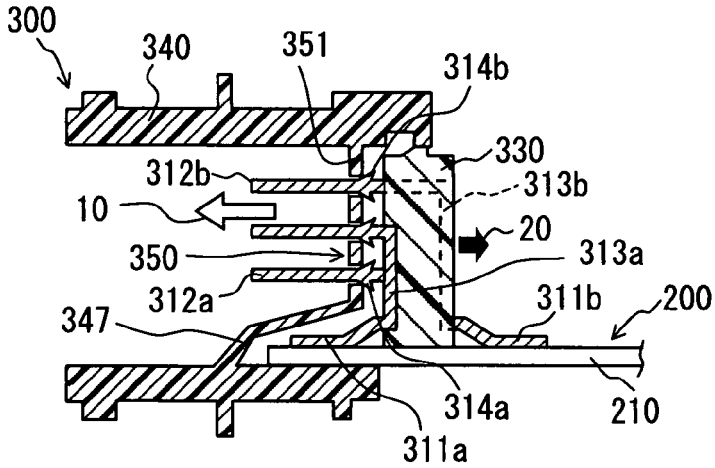
FIG. 13 is a cross sectional view of a projection of a connector terminal according to a modification of the present invention.

As shown in FIG. 13, the fourth end portion 312*b* may have a projection 314*b* corresponding to the projection 314*a* of the second end portion 312*a*. The projections 314*a*, 314*b* may hit against the base portion 351 of the third protection portion 350 in the insertion step where the second and fourth end portions 312*a*, 312*b* are inserted through the hole portion 352 in an insertion direction indicated by an arrow 10 of FIG. 13. When the projections 314*a*, 314*b* hit against the base portion 351, force is applied to the joint portions 313*a*, 313*b* in a direction indicated by an arrow 20 of FIG. 13. In the case of the first terminal 310*a*, the body member 330 is placed in the force direction indicated by the arrow 20 with respect to the joint portion 313*a*. Therefore, even when the projection 314*a* hits against the base portion 351 in the insertion step, the first terminal 310*a* can remain fixed to the body member 330. In contrast, in the case of the second terminal 310*b*, the body member 330 is placed in the opposite direction to the force direction indicated by the arrow 20 with respect to the joint portion 313*b*. Therefore, when the projection 314*b* hits against the base portion 351 in the insertion step, the second terminal 310*b* may be detached from the body member 330. Therefore, it is preferable that when the male connector 300 has both the second end portion 312*a* and the fourth end portion 312*b*, the fourth end portion 312*b* does not have the projection 314*b*.

In the embodiments described above, upper and lower portions of the fixing member 340 with respect to the circuit board 200 may have different length in the casing 400, as shown in FIG. 1A. Alternatively, the upper and lower portions of the fixing member 340 may have the same length in the casing 400.

Figure 14:
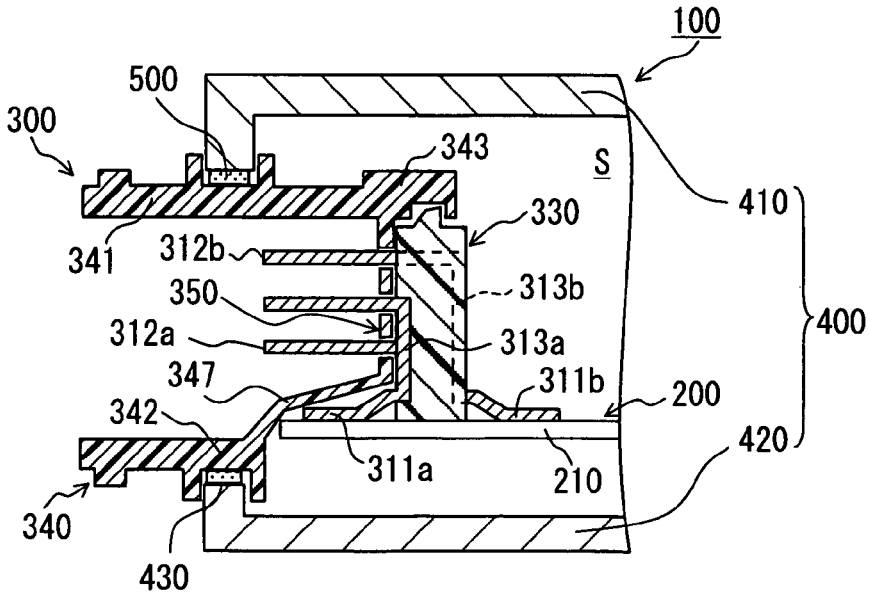
FIG. 14 is a cross-sectional view of a connector housing according to a modification of the present invention.

In the embodiments described above, the circuit board 200 and the body member 330 are at least partially received in the tube portion of the fixing member 340 as shown in FIG. 1A. Alternatively, a whole portion of the body member 330 may be outside the tube portion of the fixing member 340. Alternatively, a whole portion of each of the circuit board 200 and the body member 330 may be placed outside the tube portion of the fixing member 340, as shown in FIG. 14.

In the embodiments described above, the male connector 300 is used in the electronic apparatus 100, the inner space S of which is waterproofed by the sealant 500. In other words, the male connector 300 is used in a waterproof application. Alternatively, the male connector 300 can be used in a non-waterproof application.

Such changes and modifications are to be understood as being within the scope of the present invention as defined by the appended claims.

What is claimed is:

1. A connector mounting structure comprising:

a circuit board; and a male connector capable of being mated with an external female connector, the male connector being surface-mounted to the circuit board and including a connector housing and a plurality of first male terminals, wherein the connector housing includes a body member and a fixing member fixed to the body member, the body member having a first surface, the fixing member having a tube portion and a first protection portion, the tube portion receiving a connector housing of the female connector, each of the plurality of first male terminals is fixed in the body member and has first and second end portions and a first joint portion, the first end portion being exposed to the first surface of the body member and electrically connected to the circuit board, the second end portion being exposed to the first surface of the body member and placed above the first end portion in a thickness direction of the circuit board to be electrically connectable to a terminal of the female connector, the first joint portion connecting the first and second end portions and being fixed in the body member, and the first protection portion is placed between the first and second end portions in the thickness direction of the circuit board to cover a first facing area between each adjacent first end portion.

2. The connector mounting structure according to claim 1, wherein the first protection portion has a slope portion, and a gap between the slope portion and the circuit board decreases with a distance from the body member.

3. The connector mounting structure according to claim 1, wherein the first protection portion extends from a first position of the fixing member toward the first surface of the body member, the first end portion extends from the first surface of the body member to a second position of the fixing member, and the first position is further away from the first surface of the body member than the second position.

4. The connector mounting structure according to claim 1, wherein the first protection portion touches the first surface of the body member.

5. The connector mounting structure according to claim 1, wherein the first protection portion is made of the same material as the fixing member and unitary with the fixing member.

6. The connector mounting structure according to claim 1, wherein the fixing member further has a second protection portion touching an edge portion of the first surface of the body member.

7. The connector mounting structure according to claim 1, wherein both ends of each of the terminals extend from a common side of the body member.

8. The connector mounting structure according to claim 1, wherein the first protection portion covers the first end portion in addition to the first facing area.

9. The connector mounting structure according to claim 8, wherein the first protection portion is made of an electrically insulating material and touches the first end portion.

10. The connector mounting structure according to claim 8, wherein the first protection portion is spaced from the first end portion.

11. A connector mounting structure comprising:

a circuit board; and a male connector capable of being mated with an external female connector, the male connector being surface-mounted to the circuit board and including a connector housing and a plurality of first male terminals, wherein the connector housing includes a body member and a fixing member fixed to the body member, the body member having a first surface, the fixing member having a tube portion and a first protection portion, the tube portion receiving a connector housing of the female connector, each of the plurality of first male terminals is fixed in the body member and has first and second end portions and a first joint portion, the first end portion being exposed to the first surface of the body member and electrically connected to the circuit board, the second end portion being exposed to the first surface of the body member and placed above the first end portion in a thickness direction of the circuit board to be electrically connectable to a terminal of the female connector, the first joint portion connecting the first and second end portions and being fixed in the body member, the first protection portion is placed between the first and second end portions in the thickness direction of the circuit board to cover a first facing area between each adjacent first end portion, the body member has a plurality of slit portions on the first surface, each of the plurality of slit portions having a depth, the first joint portion is fixed in a corresponding one of the plurality of slit portions and has a thickness in the depth direction, and the depth is greater than the thickness so that a whole portion of the first joint portion is placed inside the corresponding one of the plurality of slit portions.

12. The connector mounting structure according to claim 11, wherein the fixing member further has a third protection portion that is placed in front of the first surface of the body member to cover both the first joint portion and a second facing area between each adjacent first joint portion, the second end portion has a contact portion electrically connectable to the female connector, and at least the contact portion of the second end portion is placed further forward than the third protection portion with respect to the first surface of the body member.

13. The connector mounting structure according to claim 12, wherein the third protection portion is unitary with the first protection portion.

14. The connector mounting structure according to claim 12, wherein the third protection portion is made of the same material as the fixing member and unitary with the fixing member.

15. The connector mounting structure according to claim 12, wherein the third protection portion has a base portion and a plurality of hole portions, the base portion having a first surface facing the first surface of the body member and a second surface opposite to the first surface of the base portion, each of the plurality of hole portions being defined by an inner wall of the base portion, and at least the contact portion of the second end portion is inserted through a corresponding one of the plurality of hole portions to be placed further forward than the third protection portion with respect to the first surface of the body member.

16. The connector mounting structure according to claim 15, wherein the each of the plurality of hole portions has a diameter that decreases with the distance from the first surface of the base portion so that the diameter is larger at the first surface of the base portion than the second surface of the base portion, and the inner wall of the base portion guides the second end portion through the each of the plurality of hole portions.

17. The connector mounting structure according to claim 15, wherein the inner wall of the base portion has a deformable thin-walled portion projecting toward a center of the each of the plurality of hole portions.

18. The connector mounting structure according to claim 15, wherein the each of the plurality of hole portions is a through hole penetrating through the base portion.

19. The connector mounting structure according to claim 15, wherein the third protection portion further has a thin film member attached to one of the first and second surfaces of the base portion, the each of the plurality of hole portions is a blind hole having a bottom provided by the thin film member, and at least the contact portion of the second end portion penetrates the thin film member to be placed further forward than the third protection portion with respect to the first surface of the body member.

20. The connector mounting structure according to claim 19, wherein the fixing member further has an adhesive member applied to the first surface of the base portion of the third protection portion, and the thin film member is attached to the first surface of the base portion through the adhesive member.

21. The connector mounting structure according to claim 19, wherein the fixing member further has an adhesive member applied to the one of the first and second surfaces except a portion corresponding to the bottom of the each of the plurality of hole portions, and the thin film member is attached to the one of the first and second surfaces through the adhesive member.

22. The connector mounting structure according to claim 12, wherein the second end portion except the contact portion has a projection portion extending outwardly so that the second end portion has an increased diameter at the projection portion, and the projection portion is placed further forward than the third protection portion with respect to the first surface of the body member.

23. The connector mounting structure according to claim 22, wherein the male connector further includes a plurality of second male terminals, and each of the plurality of second male terminals is fixed in the body member and has third and fourth end portions and a second joint portion, the third end portion being exposed to a second surface opposite to the first surface of the body member and electrically connected to the circuit board, the fourth end portion being exposed to the first surface of the body member to be electrically connectable to the terminal of the female connector, the second joint portion connecting the third and fourth end portions and being fixed in the body member.

* * * * *